US008667614B1

(12) United States Patent
Bacon

(10) Patent No.: US 8,667,614 B1
(45) Date of Patent: Mar. 11, 2014

(54) HAIRSTYLIST CAPE DEVICE

(71) Applicant: Patricia Bacon, Indianapolis, IN (US)

(72) Inventor: Patricia Bacon, Indianapolis, IN (US)

( * ) Notice: Subject to any disclaimer, the term of this patent is extended or adjusted under 35 U.S.C. 154(b) by 0 days.

(21) Appl. No.: 13/687,611

(22) Filed: Nov. 28, 2012

(51) Int. Cl.
*A41B 13/10* (2006.01)

(52) U.S. Cl.
USPC ..... 2/50

(58) Field of Classification Search
USPC ..... 2/46, 49, 50, 51, 52, 67, 174, 88
See application file for complete search history.

(56) References Cited

U.S. PATENT DOCUMENTS

| | | | | |
|---|---|---|---|---|
| 3,798,674 | A | 3/1974 | Daniel | |
| 4,611,354 | A * | 9/1986 | Jones | 2/174 |
| 4,709,420 | A | 12/1987 | Gettinger | |
| D308,437 | S | 6/1990 | Baldwin et al. | |
| 5,079,777 | A | 1/1992 | Fowler et al. | |
| 5,469,580 | A | 11/1995 | Sobol | |
| 6,195,799 | B1 * | 3/2001 | Davies | 2/50 |
| 6,496,985 | B1 * | 12/2002 | Faldet | 2/50 |
| 6,842,910 | B1 * | 1/2005 | Martinez | 2/50 |
| 7,788,735 | B1 | 9/2010 | Foulks | |

* cited by examiner

*Primary Examiner* — Tejash Patel

(57) ABSTRACT

A hairstylist cape device prevents runoff down a person's shirt. The device includes a flexible panel. An aperture is positioned in the panel between first and second ends and between lateral sides of the panel. A dorsal portion of the panel extends from the aperture to the first end of the panel. A flap is coupled to the panel proximate the aperture wherein the flap extends from the aperture over the dorsal section of the panel. Lateral edges of the flap extend freely away from the panel wherein the flap is configured to extend into a basin inhibiting water from coming out of the basin between the basin and the dorsal section of the panel.

20 Claims, 6 Drawing Sheets

HAIRSTYLIST CAPE DEVICE

BACKGROUND OF THE DISCLOSURE

Field of the Disclosure

The disclosure relates to cape devices and more particularly pertains to a new cape device for preventing spillage or runoff down a person's shirt.

SUMMARY OF THE DISCLOSURE

An embodiment of the disclosure meets the needs presented above by generally comprising a flexible panel having a first end, a second end, and a pair of lateral sides. The lateral sides extend between the first end and the second end. An aperture is positioned in the panel between the first end and the second end and between the lateral sides of the panel. The aperture defines a dorsal portion of the panel extending from the aperture to the first end of the panel when the panel is draped over shoulders of a person while a neck of the person extends through the aperture. A flap has a top edge, a bottom edge, and a pair of lateral edges extending between the top edge and the bottom edge. The flap is coupled to the panel proximate the aperture wherein the flap extends from the aperture over the dorsal section of the panel. The lateral edges of the flap extend freely away from the panel wherein the flap is configured to extend into a basin when the panel is positioned proximate the basin wherein the flap inhibits water from coming out of the basin between the basin and the dorsal section of the panel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
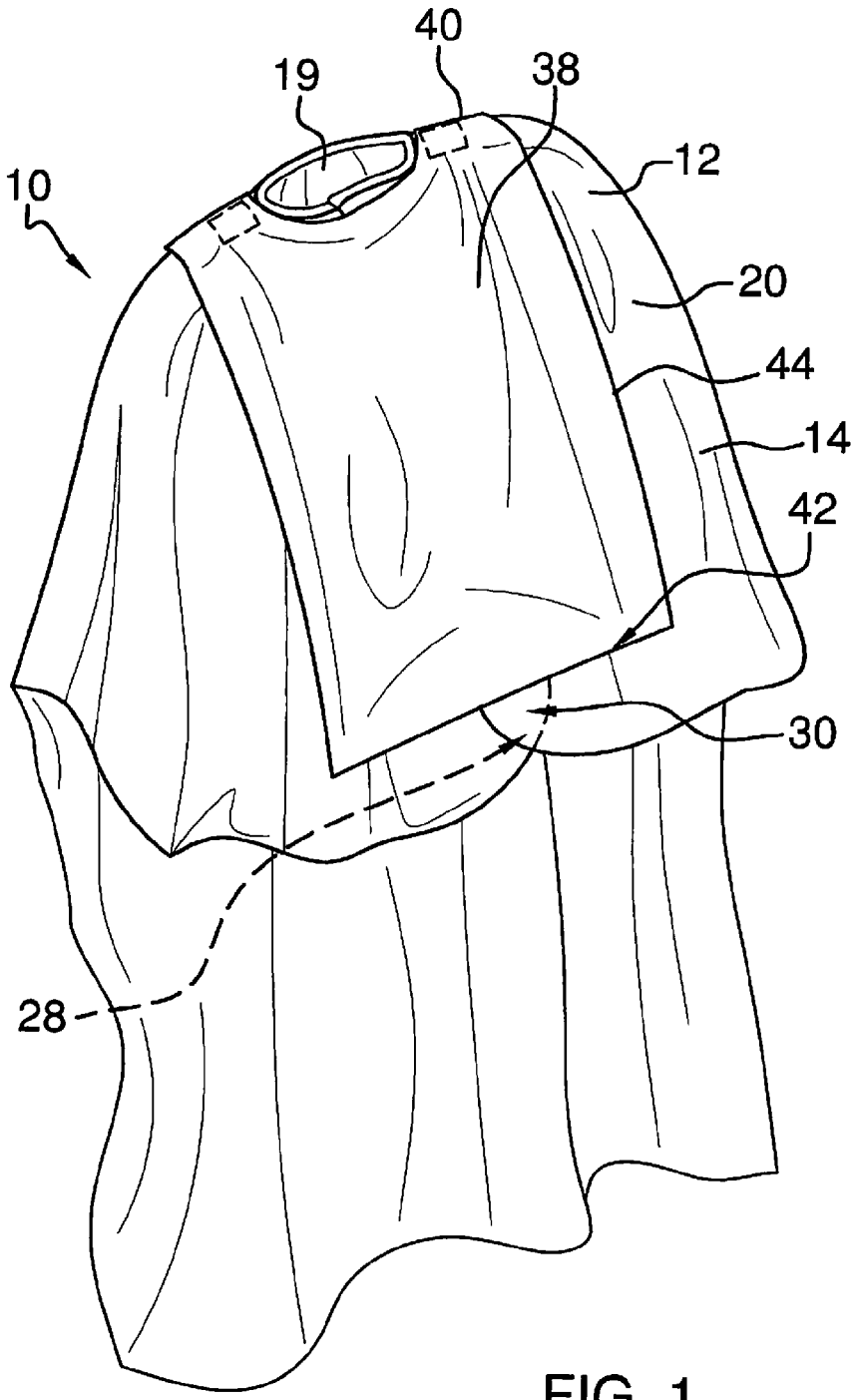
FIG. 1 is a top front side perspective view of a hairstylist cape device according to an embodiment of the disclosure.
Figure 2:
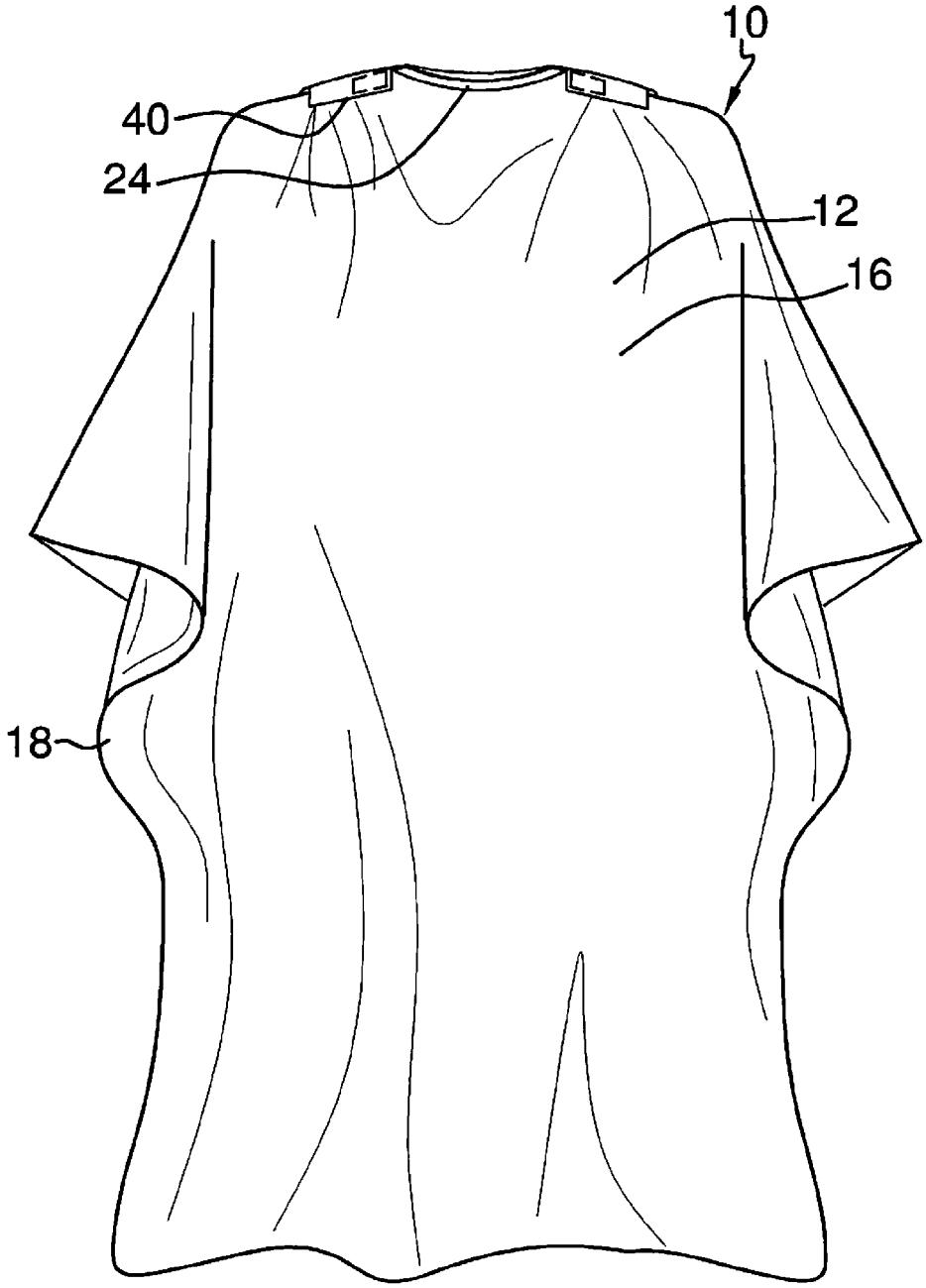
FIG. 2 is a front view of an embodiment of the disclosure.
Figure 3:
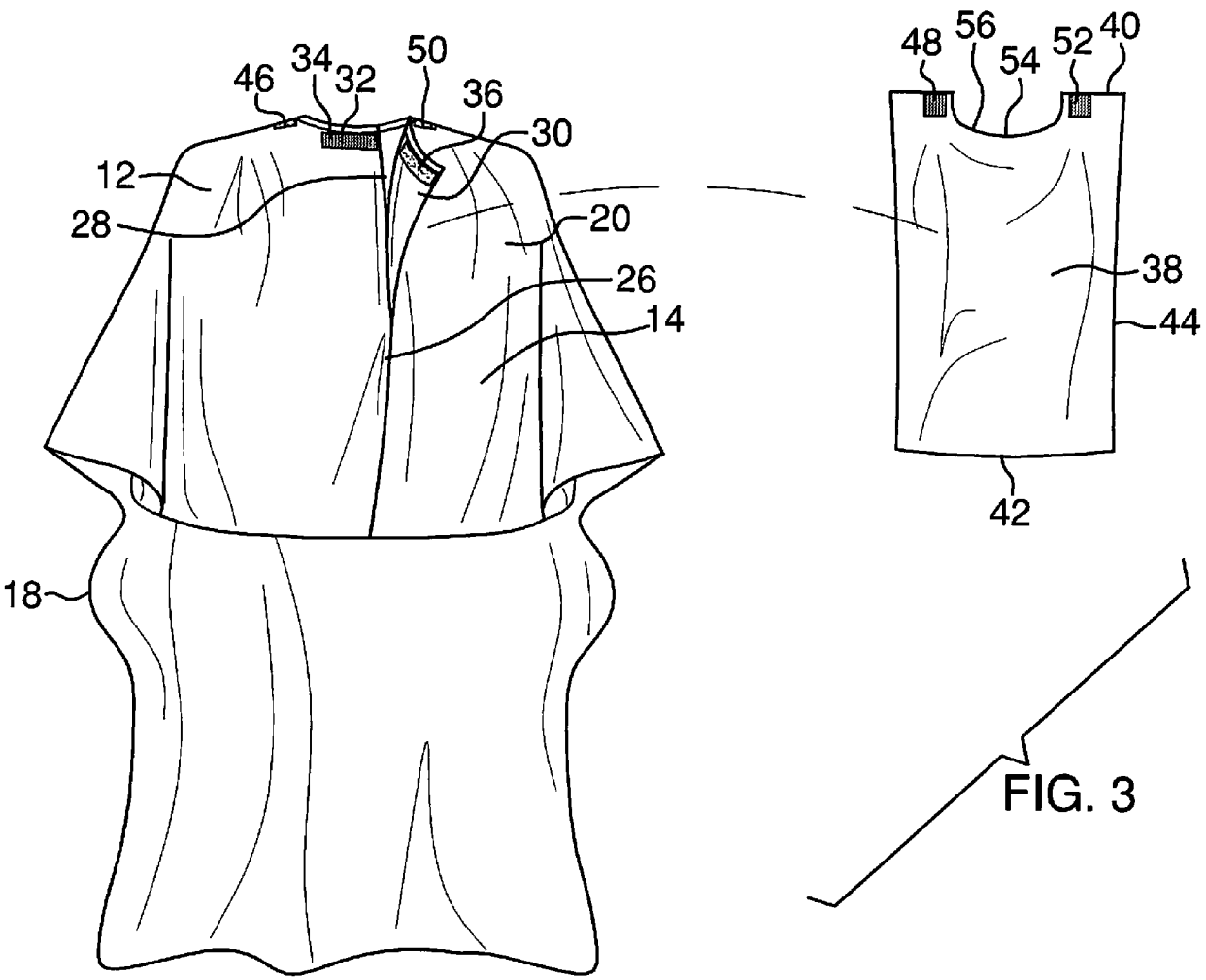
FIG. 3 is a partially exploded back view of an embodiment of the disclosure.
Figure 4:
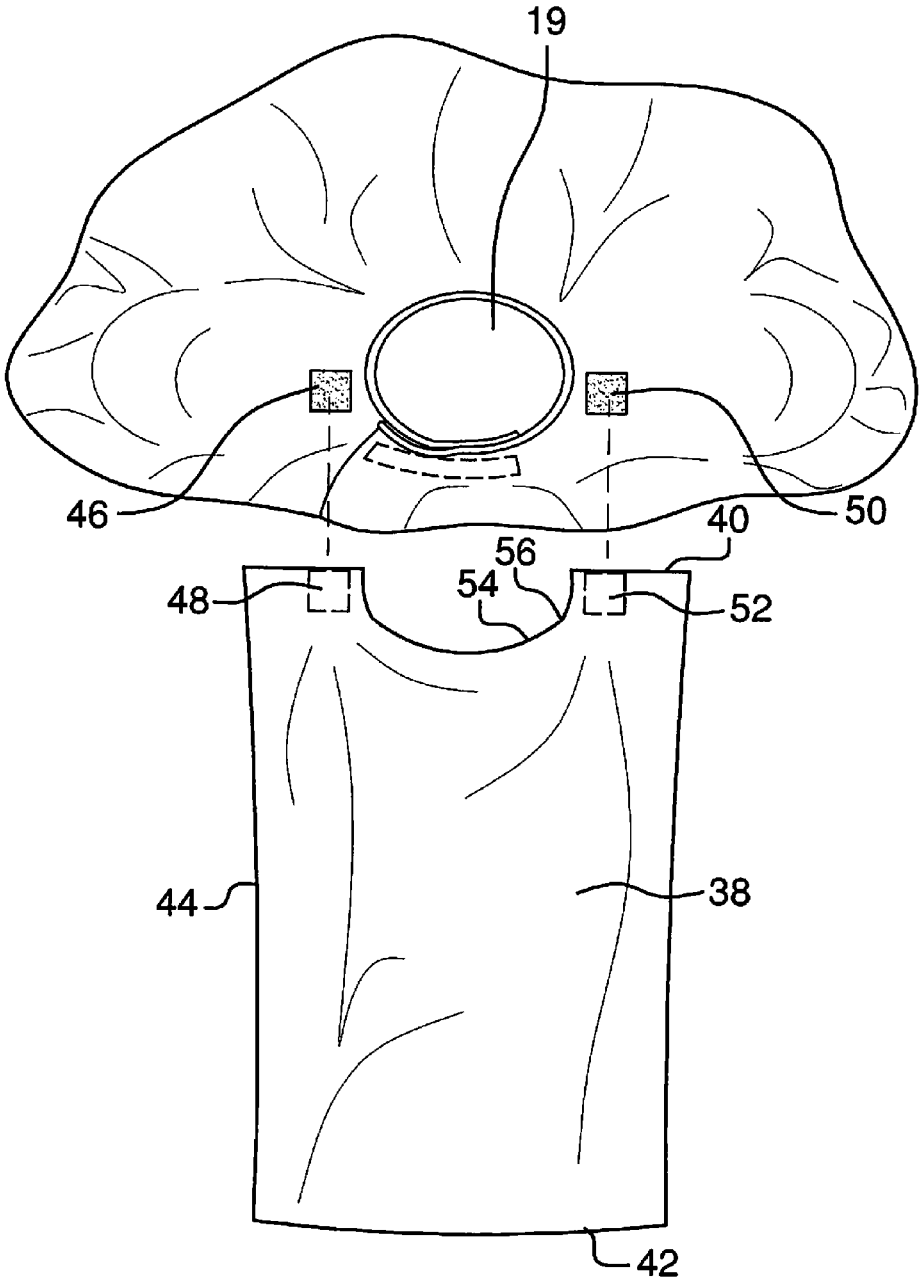
FIG. 4 is a partially exploded top view of an embodiment of the disclosure.
Figure 5:
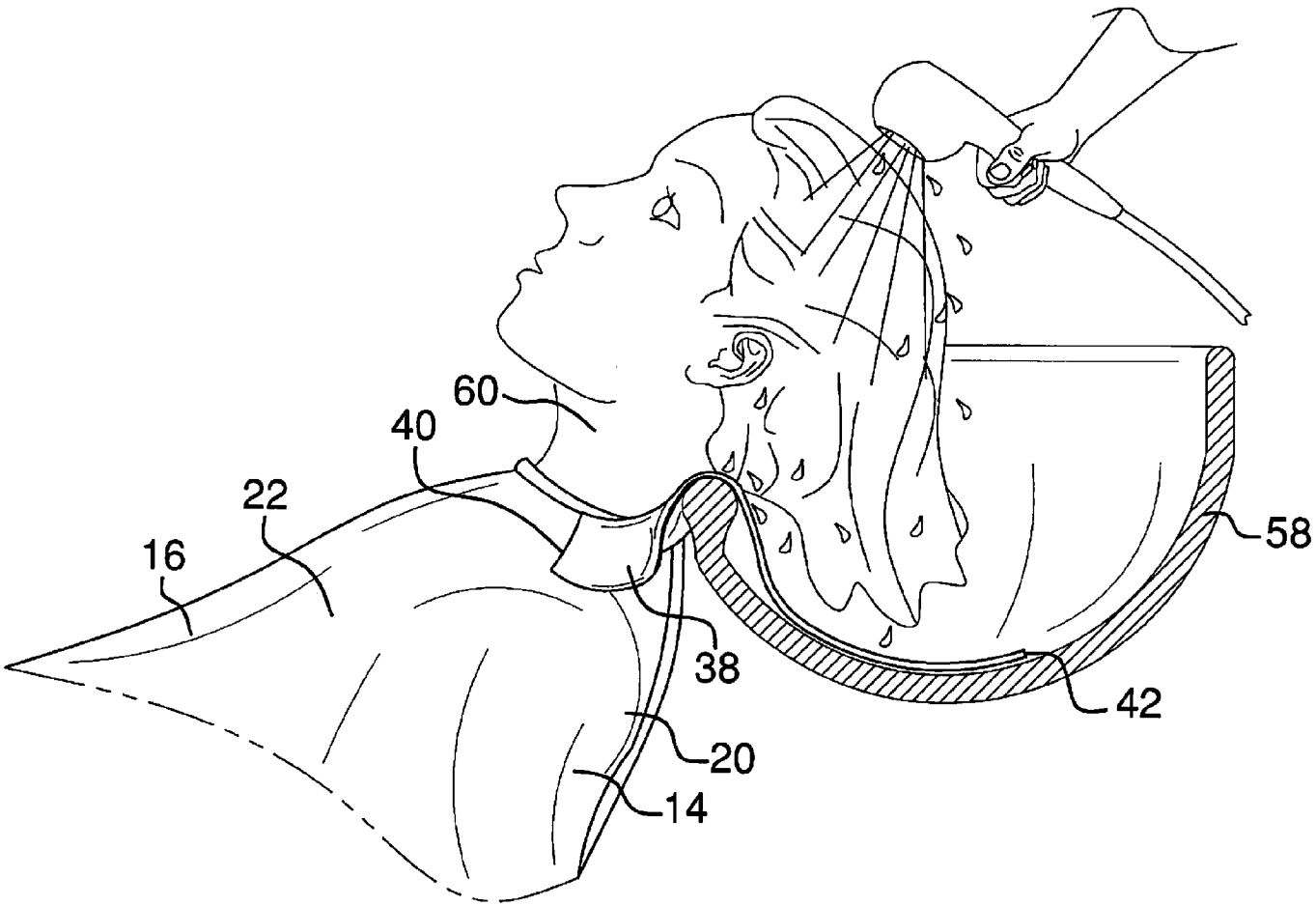
FIG. 5 is a side view of an embodiment of the disclosure in use.
Figure 6:
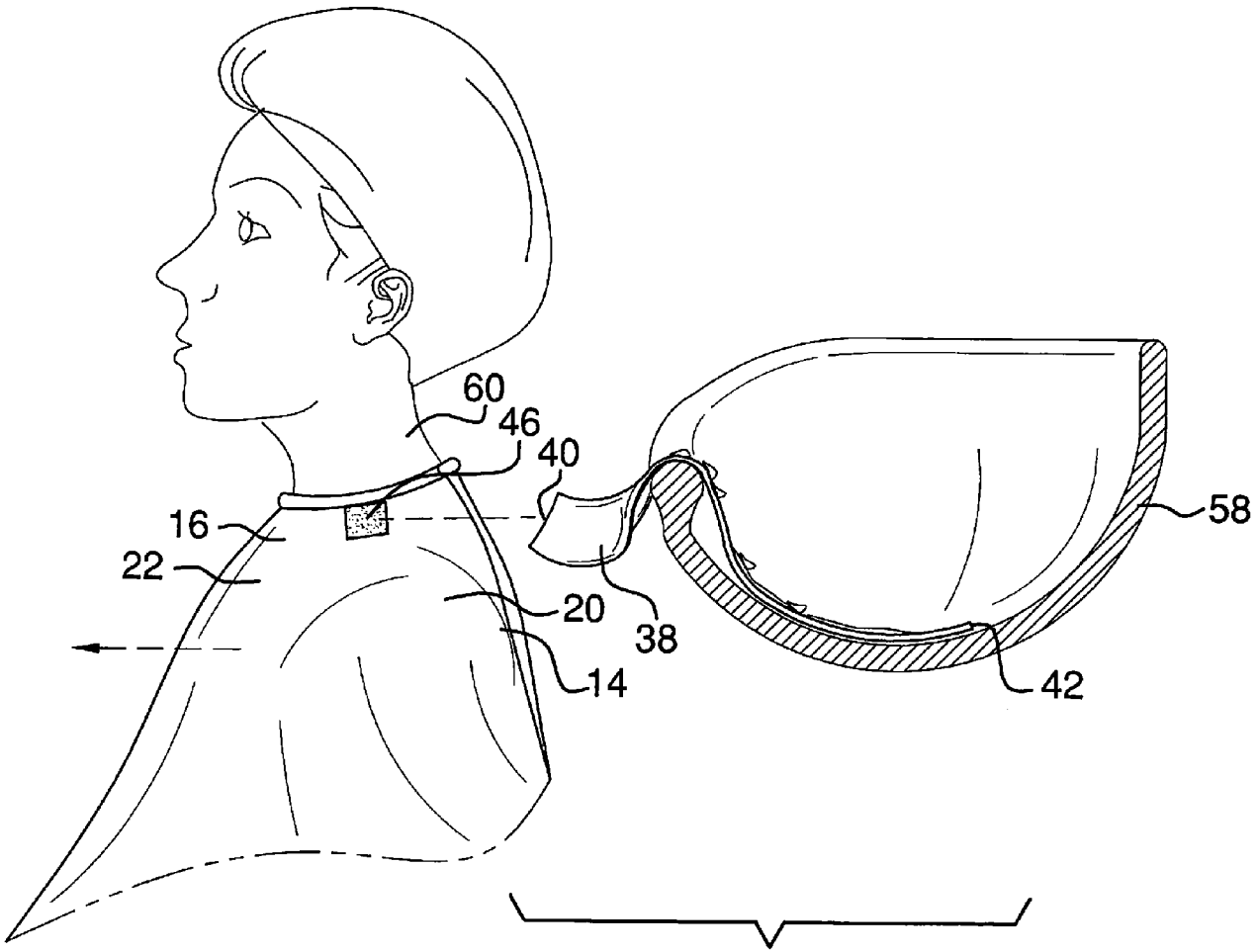
FIG. 6 is a side view of an embodiment of the disclosure in use.

With reference now to the drawings, and in particular to FIGS. 1 through 6 thereof, a new cape device embodying the principles and concepts of an embodiment of the disclosure and generally designated by the reference numeral 10 will be described.

As best illustrated in FIGS. 1 through 6, the hairstylist cape device 10 generally comprises a flexible panel 12 having a first end 14, a second end 16, and a pair of lateral sides 18. The lateral sides 18 extend between the first end 14 and the second end 16. The panel 12 preferably has a length that extends along a torso of a person wearing the panel 12 such that skin and clothing of the person is shielded from water, shampoo, and other products. The panel 12 is preferably comprised of water-repellant material and is of the type conventionally used in the hair salon industry.

An aperture 19 is positioned in the panel 12 between the first end 14 and the second end 16 and between the lateral sides 18 of the panel 12. The aperture 19 defines a dorsal portion 20 of the panel 12 extending from the aperture 19 to the first end 14 of the panel 12 when the panel 12 is draped over shoulders of a person while a neck 60 of the person extends through the aperture 19. The aperture 19 further defines a ventral portion 22 of the panel 12 extending from a forward edge 24 of the aperture 19 to the second end 16 of the panel 12 when the panel 12 is draped over the shoulders of the person while the neck 60 of the person is positioned in the aperture 19.

A slit 26 extends between the first end 14 of the panel 12 and the aperture 19. The slit 26 extends transversely between the aperture 19 and the first end 14 of the panel 12. The slit 26 forms first and second overlapping sections 28, 30 of the panel 12 extending from the aperture 19. A fastener 32 is coupled to the first and second overlapping sections 28, 30 of the panel 12 wherein a circumference of the aperture 19 is adjustable to custom-fit around a person's neck 60. The fastener 32 comprises complimentary portions 34, 36 of a hook and loop fastener. Each of the complimentary portions 34, 36 of the hook and loop fastener is an elongated strip positioned adjacent to the aperture 19.

A flap 38 has a top edge 40, a bottom edge 42, and a pair of lateral edges 44 extending between the top edge 40 and the bottom edge 42. The flap 38 is removably coupled to the panel 12 proximate the aperture 19. The flap 38 extends from the aperture 19 over the dorsal portion 20 of the panel 12 over the overlapping sections 28, 30 of the panel 12. The lateral edges 44 of the flap 38 extend freely away from the panel 12. The flap 38 is configured to extend into a basin 58 when the panel 12 is positioned proximate the basin 58 such that the flap 38 inhibits water from coming out of the basin 58 between the basin 58 and the dorsal portion 20 of the panel 12. The flap 38 preferably has a substantially rectangular shape. The flap 38 has a length defined by a distance between the top edge 40 and the bottom edge 42 and a width defined by a distance between the lateral edges 44. The length may be between approximately 34 centimeters and 40 centimeters, and the width may be between approximately 26 centimeters and 32 centimeters. The flap 38 may be made of vinyl or other water-repellant materials. The flap 38 may also be reusable or of a single-use disposable variety.

A first pair of spaced connectors 46 is coupled to the panel 12. The aperture 19 is positioned between the first pair of spaced connectors 46. A second pair of spaced connectors 48 is coupled to the flap 38. The second pair of spaced connectors 48 is complimentary to the first pair of spaced connectors 46 wherein the flap 38 is selectively coupled to the panel 12. The first and second pairs of spaced connectors 46, 48 comprise complimentary portions 50, 52 of a hook and loop fastener. An arcuate medial section 54 of the top edge 40 of the panel 12 defines a notch 56 extending into the top edge 40 of the flap 38. The notch 56 is positioned between the second pair of spaced connectors 48 wherein the notch 56 is substantially aligned with the aperture 19 when the flap 38 is coupled to the panel 12.

In use, as stated above and shown in the Figures, the panel 12 is secured around the neck 60 of a person, such that the panel 12 is draped over the torso and shoulders of the person, while the neck 60 of the person extends through the aperture 19. The flap 36 is coupled to the panel 12 and the lateral edges 42 of the flap 36 extend freely away from the panel 12. The flap 36 is configured to extend into a basin 58 when the panel 12 is positioned proximate the basin 58. Such configuration ensures that the flap 36 inhibits water from coming out of the basin 58 between the basin 58 and the dorsal portion 20 of the panel 12, thereby preventing spillage or runoff from running down a person's shirt. After use, the flap 36 can be detached from the panel 12 and left in the basin 58.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A hairstylist cape device comprising:

a flexible panel having a first end, a second end, and a pair of lateral sides extending between said first end and said second end;

an aperture being positioned in said panel between said first end and said second end and between said lateral sides of said panel, said aperture defining a dorsal portion of said panel extending from said aperture to said first end of said panel when said panel is draped over shoulders of a person while a neck of the person extends through said aperture; and a flap having a top edge, a bottom edge, and a pair of lateral edges extending between said top edge and said bottom edge, said flap being coupled to said panel proximate said aperture wherein said flap extends from said aperture over said dorsal portion of said panel, said flap being selectively removable from said panel, said lateral edges of said flap extending freely away from said panel wherein said flap is configured to extend into a basin when said panel is positioned proximate the basin wherein said flap inhibits water from coming out of the basin between the basin and said dorsal section of said panel.

2. The device of claim 1, further comprising said aperture defining a ventral portion of said panel extending from a forward edge of said aperture to a second end of said panel when said panel is draped over the shoulders of the person while the neck of the person is positioned in said aperture.

3. The device of claim 1, further comprising said panel being constructed of water-repellant material.

4. The device of claim 1, further comprising a first pair of spaced connectors being coupled to said panel, said aperture being positioned between said first pair of spaced connectors, said device further comprising a second pair of spaced connectors being coupled to said flap, said second pair of spaced connectors being complementary to said first pair of spaced connectors wherein said flap is selectively coupled to said panel.

5. The device of claim 1, further comprising a slit extending between said first end of said panel and said aperture.

6. A hairstylist cape device comprising:

a flexible panel having a first end, a second end, and a pair of lateral sides extending between said first end and said second end;

an aperture being positioned in said panel between said first end and said second end and between said lateral sides of said panel, said aperture defining a dorsal portion of said panel extending from said aperture to said first end of said panel when said panel is draped over shoulders of a person while a neck of the person extends through said aperture;

a slit extending between said first end of said panel and said aperture, said slit extending transversely between said aperture and said first end of said panel; and a flap having a top edge, a bottom edge, and a pair of lateral edges extending between said top edge and said bottom edge, said flap being coupled to said panel proximate said aperture wherein said flap extends from said aperture over said dorsal portion of said panel, said lateral edges of said flap extending freely away from said panel wherein said flap is configured to extend into a basin when said panel is positioned proximate the basin wherein said flap inhibits water from coming out of the basin between the basin and said dorsal section of said panel.

7. The device of claim 6, further comprising a fastener coupled to said panel, said fastener selectively holding said slit in a closed position.

8. The device of claim 1, further comprising a circumference of said aperture being adjustable.

9. The device of claim 6, further comprising said slit defining first and second overlapping sections of said panel adjacent to said slit and extending from said aperture to said first end of said panel.

10. The device of claim 9, further comprising said fastener being coupled to said first and second overlapping sections of said panel.

11. The device of claim 7, further comprising said fastener comprising complementary portions of a hook and loop fastener.

12. The device of claim 11, further comprising each of said complementary portions of said hook and loop fastener being positioned adjacent to said aperture.

13. The device of claim 12, further comprising said complementary portions of said hook and loop fastener being elongated strips.

14. A hairstylist cape device comprising:

a flexible panel having a first end, a second end, and a pair of lateral sides extending between said first end and said second end;

an aperture being positioned in said panel between said first end and said second end and between said lateral sides of said panel, said aperture defining a dorsal portion of said panel extending from said aperture to said first end of said panel when said panel is draped over shoulders of a person while a neck of the person extends through said aperture, said aperture further defining a ventral portion of said panel extending from a forward edge of said aperture to said second end of said panel when said panel is draped over the shoulders of the person while the neck of the person is positioned in the aperture;

a slit extending between said first end of said panel and said aperture, said slit extending transversely between said aperture and said first end of said panel, said slit forming first and second overlapping sections of said panel extending from said aperture;

a fastener coupled to said first and second overlapping sections of said panel wherein a circumference of said aperture is adjustable, said fastener being complementary portions of hook and loop fastener, each of said complementary portions of hook and loop fastener being an elongated strip positioned adjacent to said aperture;

a flap having a top edge, a bottom edge, and a pair of lateral edges extending between said top edge and said bottom edge, said flap being removably coupled to said panel proximate said aperture wherein said flap extends from said aperture over said dorsal section of said panel over said overlapping sections of said panel, said lateral edges of said flap extending freely away from said panel wherein said flap is configured to extend into a basin when said panel is positioned proximate the basin wherein said flap inhibits water from coming out of the basin between the basin and the dorsal section of the panel;

a first pair of spaced connectors being coupled to said panel, said aperture being positioned between said first pair of spaced connectors;

a second pair of spaced connectors being coupled to said flap, said second pair of spaced connectors being complementary to said first pair of spaced connectors wherein said flap is selectively coupled to said panel, said first and second pairs of spaced connectors comprising complementary portions of hook and loop fastener; and an arcuate medial section of said top edge of said panel defining a notch extending into said top edge of said flap, said notch being positioned between said second pair of spaced connectors wherein said notch is substantially aligned with said aperture when said flap is coupled to said panel.

15. The device of claim 6, further comprising said aperture defining a ventral portion of said panel extending from a forward edge of said aperture to a second end of said panel when said panel is draped over the shoulders of the person while the neck of the person is positioned in said aperture.

16. The device of claim 6, further comprising said panel being constructed of water-repellant material.

17. The device of claim 6, further comprising a circumference of said aperture being adjustable.

18. The device of claim 17, further comprising a fastener coupled to said panel, said fastener selectively holding said slit in a closed position, said fastener comprising complementary portions of a hook and loop fastener.

19. The device of claim 18, further comprising each of said complementary portions of said hook and loop fastener being positioned adjacent to said aperture.

20. The device of claim 19, further comprising said complementary portions of said hook and loop fastener being elongated strips.

* * * * *